US007817947B2

(12) United States Patent
Nishikawa et al.

(10) Patent No.: US 7,817,947 B2
(45) Date of Patent: Oct. 19, 2010

(54) IMAGE FORMING APPARATUS AND CORRECTION METHOD OF COLOR-MISREGISTRATION IN AN IMAGE

(75) Inventors: Eiji Nishikawa, Hino (JP); Satoshi Ogata, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 390 days.

(21) Appl. No.: 12/059,980

(22) Filed: Mar. 31, 2008

(65) Prior Publication Data

US 2009/0003893 A1 Jan. 1, 2009

(30) Foreign Application Priority Data

Jun. 26, 2007 (JP) ..... 2007-167530

(51) Int. Cl.
*G03G 15/01* (2006.01)
*G03G 15/00* (2006.01)

(52) U.S. Cl. ..... 399/301; 399/49

(58) Field of Classification Search ..... 399/49, 399/66, 72, 299, 301; 347/116
See application file for complete search history.

(56) References Cited

U.S. PATENT DOCUMENTS 7,693,437 B2 * 4/2010 Hano et al. ..... 399/49
7,693,467 B2 * 4/2010 Kadowaki ..... 399/301
2007/0053727 A1 * 3/2007 Goto ..... 399/301

FOREIGN PATENT DOCUMENTS

JP 07234612 A * 9/1995
JP 08-085234 4/1996
JP 10148992 A * 6/1998
JP 2006293240 A * 10/2006

* cited by examiner

*Primary Examiner*—Robert Beatty
(74) *Attorney, Agent, or Firm*—Squire, Sanders & Dempsey L.L.P.

(57) ABSTRACT

An image forming apparatus that corrects color misregistration of an image including: an image forming device having an endless image carrier for carrying an image to be formed on the recording medium, wherein the image forming device forms the image in an image area that corresponds to the recording medium on the image carrier and also forms a color misregistration correction mark in an image boundary area that is sandwiched between the image area and the next image area following the image area on the image carrier; a mark detecting section for detecting the correction mark on the image boundary area; and a control device to change an interval for feeding the recording medium based on a fluctuating period of the color misregistration corresponding to an orbiting distance of the image carrier, and to expand image boundary area of the image carrier to form the mark at a changed position.

5 Claims, 11 Drawing Sheets

FIG. 4 (A)

| No. | PERIOD |
|---|---|
| 1 | 431 |
| 2 | 1293 |
| 3 | 2155 |
| 4 | 3017 |
| • | • |
| • | • |
| • | • |

FIG. 4 (B)

| No. | MARK POSITION |
|---|---|
| 1 | 210 |
| 2 | 486.9 |
| 3 | 763.8 |
| 4 | 1040.7 |
| 5 | 1317.6 |
| 6 | 1594.5 |
| 7 | 1871.4 |
| 8 | 2148.3 |
| 9 | 2425.2 |
| 10 | 2702.1 |
| 11 | 2979 |
| 12 | 3255.9 |
| 13 | 3532.8 |
| • | • |
| • | • |
| • | • |

IMAGE FORMING APPARATUS AND CORRECTION METHOD OF COLOR-MISREGISTRATION IN AN IMAGE

RELATED APPLICATION

This application is based on Japanese Patent Application No. 2007-167530 filed on Jun. 26, 2007 in Japan Patent Office, the entire content of which is hereby incorporated by reference.

BACKGROUND

1. Field of the Invention

The present invention relates to an image forming apparatus and correction method of color misregistration in an image which are applicable to the color printer, color photocopier, and a multifunction peripheral wherein the color misregistration of the image formed on a recording medium is corrected.

2. Description of Related Art

In the color photocopiers developed in recent years, efforts are being made to solve the problem of color misregistration caused by a rise in temperature of the apparatus during the feed of the recording medium with the lapse of time. In many of these efforts, the feed of the recording medium is suspended under a predetermined condition (e.g., after detection of a predetermined temperature change, after passage of a predetermined number of sheets, or after lapse of a predetermined time), whereby color misregistration is corrected.

In another effort to solve the problem, to prevent suspension of the feed of the recording medium, a registration mark is formed in the image boundary sandwiched between the image area of the page formed on the transfer belt and the image area on the next page during paper feed, whereby this registration mark is detected and color misregistration is corrected.

In connection to the conventional example, an image forming apparatus is disclosed in the Unexamined Japanese Patent Application Publication No. 8-85234 (FIG. 9 on page 3). In this image forming apparatus, each registration mark formed in the space between the sheets of paper on the transfer belt is read, and the central position of this registration mark is analyzed, so that mechanical or electrical correction of the image forming device is performed. This arrangement allows the required registration correction to be carried out parallel with the image formation by the image forming device.

SUMMARY

According to one aspect of the present invention, there is provided an image forming apparatus that corrects color misregistration of an image to be formed on a recording medium, the image forming apparatus comprising: a conveyance device for conveying the recording medium; an image forming device having an endless image carrier for carrying an image to be formed on the recording medium, wherein the image forming device forms the image in an image area that corresponds to the recording medium on the image carrier and also forms a color misregistration correction mark in an image boundary area that is sandwiched between the image area and the next image area following the image area on the image carrier; a mark detecting section for detecting the color misregistration correction mark formed on the image boundary area of the image carrier by the image forming device; and a control device for providing control in such a way that the color misregistration of the image formed on the recording medium is controlled based on the color misregistration correction mark detected by the mark detecting section; wherein, under a color misregistration correction mode in which operations of forming the image in the area based on input image information, forming the color misregistration correction mark on the image boundary area of the image carrier, and correcting the color misregistration based on the color misregistration correction mark are executed, the control device controls the conveyance device in such a way that an interval for feeding the recording medium is changed, based on a fluctuating period of the color misregistration corresponding to an orbiting distance of the image carrier, and controls the image forming device in such a way that the image boundary area of the image carrier is expanded, and the color misregistration correction mark is formed at a position changed.

According to another aspect of the invention, there is provided the image forming apparatus as described in said one aspect of the present invention, further comprising a storage section for storing a value as the optimum mark forming position, wherein on the assumption of existence of a plurality of color misregistration correction marks formed at a predetermined interval each other in each image boundary area, among values those are odd number of times the half cycle in the fluctuating period, the value as the optimum mark forming position represents a position that is closest to any one of color misregistration correction marks in each image boundary area; wherein, in the color misregistration correction mode, the control device reads the value as the optimum mark forming position stored in the storage section and controls the conveyance device and image forming device based on this optimum mark forming position.

According to further aspect of the present invention, there is provided a color misregistration correction method for correcting color misregistration of an image to be formed on a recording medium, the method comprising: under a color misregistration correction mode in which operations of forming the image in an image area that corresponds to the recording medium based on input image information, forming a color misregistration correction mark on an image boundary area that is sandwiched between the image area and the next image area following the image area of the image carrier, and correcting the color misregistration based on the color misregistration correction mark are executed, changing an interval for feeding the recording medium based on a fluctuating period of the color misregistration corresponding to an orbiting distance of the image carrier; expanding the image boundary area of the image carrier; and forming the color misregistration correction mark at a position in the image boundary area that is changed from a position at which the color misregistration correction mark was previously formed; detecting the color misregistration correction mark at the changed position; and correcting color misregistration of the image to be formed on the recording medium based on the detected color misregistration correction mark.

According to still further aspect of the present invention, there is provided an image forming apparatus that corrects color misregistration of an image to be formed on a recording medium, the image forming apparatus comprising: a conveyance device for conveying the recording medium; an image forming device having an endless image carrier for carrying an image to be formed on the recording medium, wherein the image forming device forms the image in an image area that corresponds to the recording medium on the image carrier and also forms a color misregistration correction mark in an image boundary area that is sandwiched between the image area and the next image area following the image area on the image carrier; a mark detecting section for detecting the color misregistration correction mark formed on the image boundary area of the image carrier by the image forming device, and the marks formed on the image carrier at predetermined intervals; and a control device for providing control in such a way that the color misregistration of the image formed on the recording medium is controlled based on the color misregistration correction mark detected by the mark detecting section; wherein, under a color misregistration correction mode in which operations of forming the image in the area based on input image information, forming the color misregistration correction mark on the image boundary area of the image carrier, and correcting the color misregistration based on the color misregistration correction mark are executed, the control device calculates a period of a difference between the each position of the marks formed on the image carrier at predetermined intervals and a reference position providing a basis for the mark based on the difference; and controls the conveyance device in such a way that an interval for feeding the recording medium is changed, based on a fluctuating period of the color misregistration corresponding to an orbiting distance of the image carrier, and controls the image forming device in such a way that the image boundary area of the image carrier is expanded, and the color misregistration correction mark is formed at a position changed.

According to yet another aspect of the present invention, there is provided a color misregistration correction method for correcting color misregistration of an image to be formed on a recording medium, the method comprising: under a color misregistration correction mode in which operations of forming the image in an image area that corresponds to the recording medium based on input image information, forming a color misregistration correction mark on an image boundary area that is sandwiched between the image area and the next image area following the image area of the image carrier, and correcting the color misregistration based on the color misregistration correction mark are executed, forming marks on the image carrier at predetermined intervals; detecting the marks formed on the image carrier at predetermined intervals; calculating the positions of the marks at predetermined intervals; calculating a period of a difference between the each position of the marks formed on the image carrier at predetermined intervals and a reference position providing a basis for the mark based on the difference; changing an interval for feeding the recording medium based on the calculated period of the difference; expanding the image boundary area of the image carrier; forming the color misregistration correction mark at a position in the image boundary area that is changed from a position at which the color misregistration correction mark was previously formed; detecting the color misregistration correction mark at the changed position; and correcting color misregistration of the image to be formed on the recording medium based on the detected color misregistration correction mark.

BRIEF DESCRIPTION OF THE DRAWINGS

FIGS. 4 (A) and 4(B) are explanatory diagrams showing an example of calculating the optimum mark position;

DETAILED DESCRIPTION OF THE PREFERRED EMBODIMENTS

Referring to these drawings, the following describes an image forming apparatus and correction method of color misregistration in an image as an embodiment of the present invention:

Embodiment 1

Figure 1:
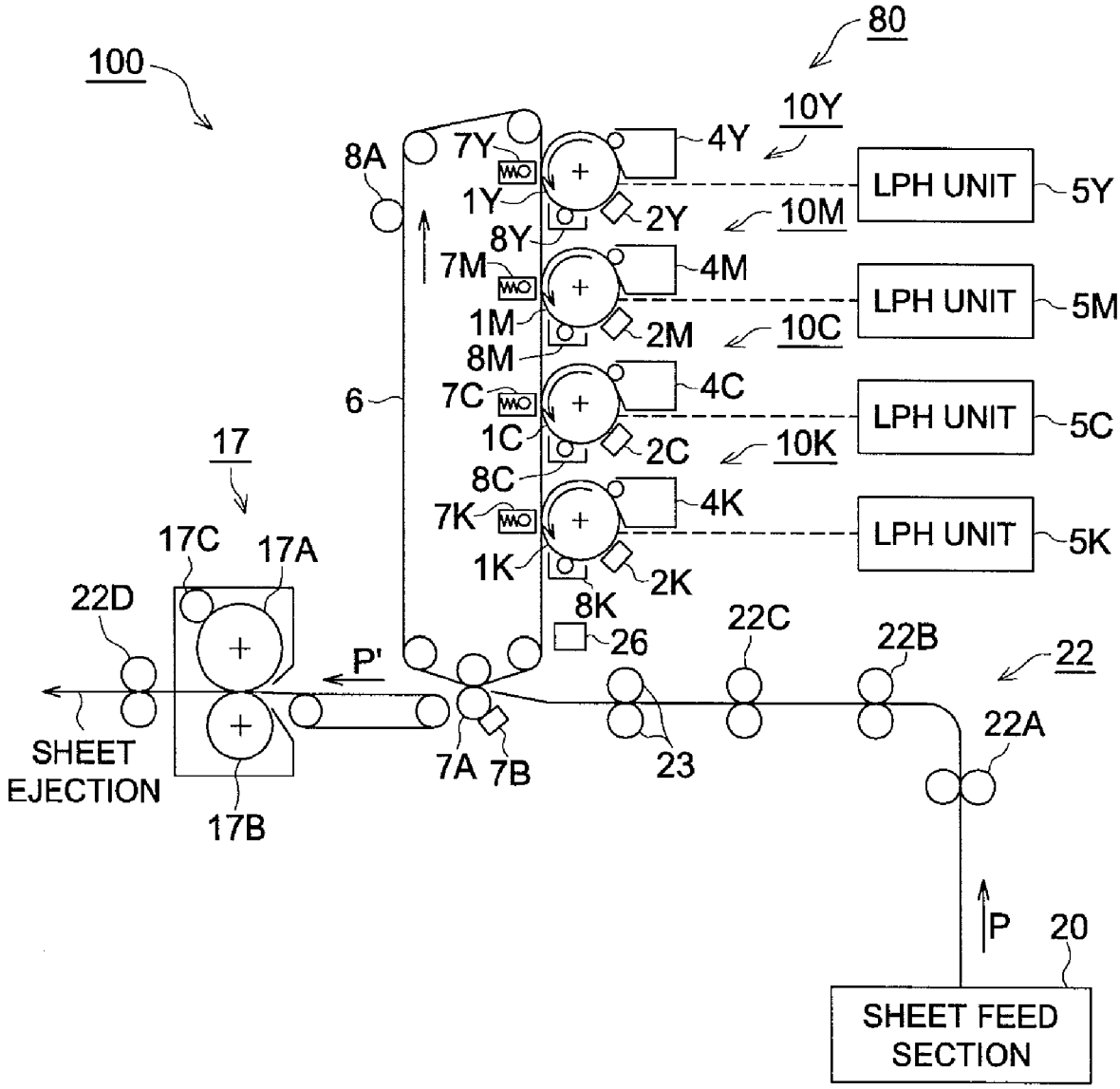
FIG. 1 is a schematic view representing an example of the structure of a color photocopier 100 as an embodiment of the present invention.

FIG. 1 is a schematic view representing an example of the structure of a color photocopier 100 as an embodiment of the present invention. The tandem type color photocopier 100 of FIG. 1 provides an example of the image forming apparatus, and corrects the color misregistration of an image formed on paper.

The color photocopier 100 drives a plurality of photoreceptor drums 1Y, 1M, 1C, and 1K in response to the digital color image and superimposes the color image formed by these photoreceptor drums on the intermediate transfer belt 6. The color image is then transferred to paper P. The photoreceptor drums 1Y, 1M, 1C, and 1K and intermediate transfer belt 6 constitute examples of the image carrier.

Figure 8:
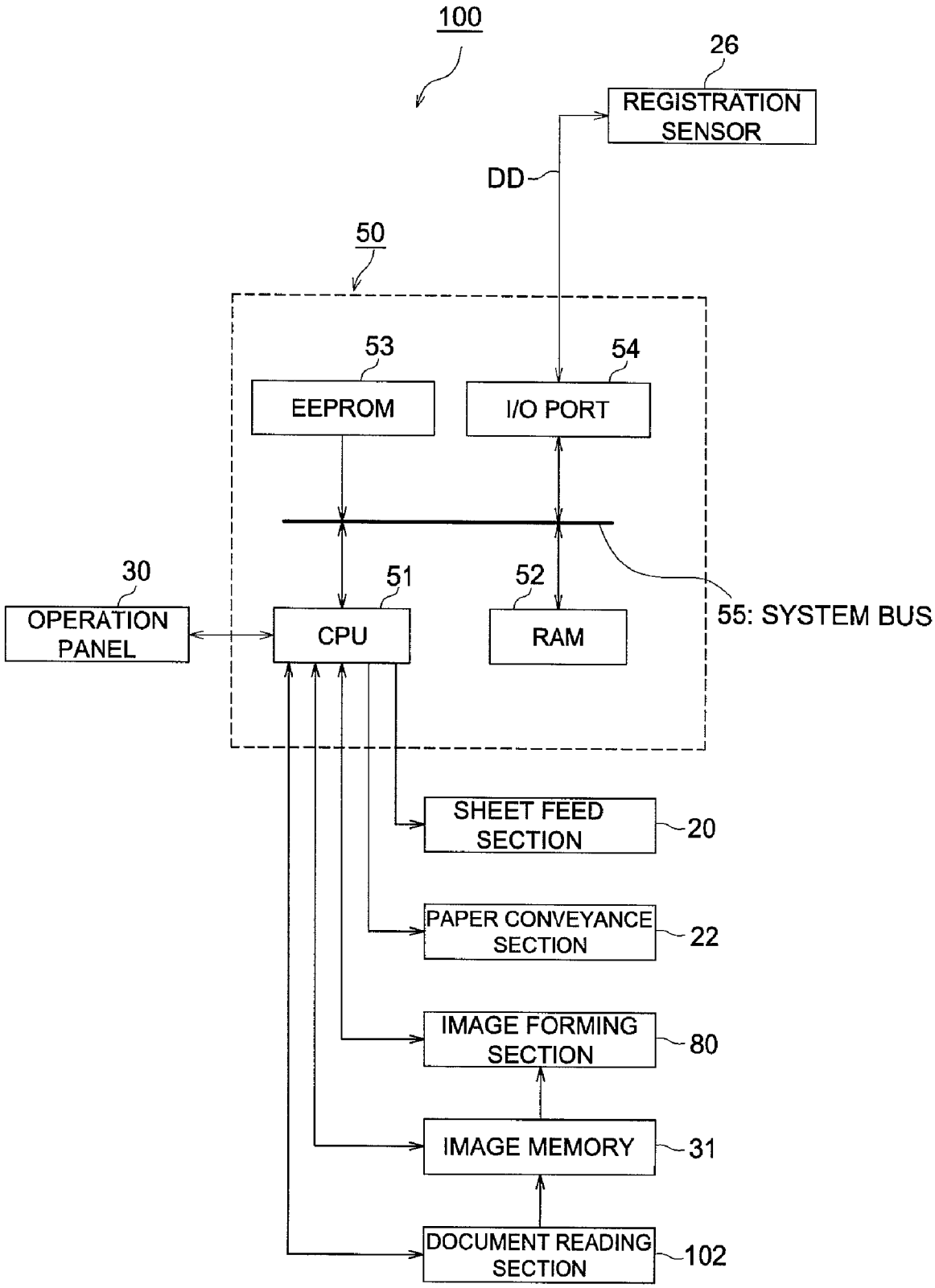
FIG. 8 is a block diagram showing an example of the structure of the control system of a color photocopier 100.

The color image information is outputted from the document reading section 102 shown in FIG. 8. For example, this document reading section 102 is made up of an automatic document feeder (ADF) (not illustrated) and document image scanning exposure apparatus. In this example, the document placed on the ADF document platen is conveyed by a conveyance device, and the document image surface is subjected to scanning and exposure by the optical system of the document image scanning exposure apparatus. The image information is read from the document by a CCD pickup device to get the image signal which is then outputted. The image signal having been subjected to photoelectric conversion by the CCD pickup device is subjected to A/D conversion and shading correction by an image processing device (not illustrated), and is converted into digital color image information R-DATA, G-DATA, and B-DATA (hereinafter referred to as "image input data R, G, and B"). The image input data R, G, and B undergoes predetermined image processing. The image forming data Y, M, C, and BK subsequent to image processing is outputted to the image forming section 80.

The image forming section 80 constitutes an example of the image forming device. When the color misregistration correction mode is executed, the color image and color misregistration correction mark (registration mark 41*a* of FIG. 6 (B)) is formed on the intermediate transfer belt 6 by the photoreceptor drums 1Y, 1M, 1C, and 1K.

The operations in the color misregistration correction mode can be explained as follows: For example, the area sandwiched between the transfer paper area (image area) 40 (FIG. 7 (A)) of the page formed on the intermediate transfer belt 6 according to the image input data R, G, and B, and the transfer paper area 40 on the next page is assumed as the image area (L2 denoting the space between sheets), and an image is formed on the transfer paper area 40 of the intermediate transfer belt 6 according to the image input data R, G, and B. At the same time, a registration mark 41 is formed in the image area of the intermediate transfer belt 6 and the color misregistration is corrected according to this registration mark 41.

The image forming section 80 includes an image forming unit 10Y having a photoreceptor drum 1Y for yellow (Y), an image forming unit 10M having a photoreceptor drum 1M for magenta (M), an image forming unit 10C having a photoreceptor drum 1C for cyan (C), image forming unit 10K having a photoreceptor drum 1K for black (K), and an endless intermediate transfer belt 6. The image forming section 80 forms an image for each of the photoreceptor drums 1Y, 1M, 1C, and 1K, and the toner images of respective colors produced by photoreceptor drums 1Y, 1M, 1C, and 1K of respective colors are superimposed on the intermediate transfer belt 6, whereby an color image is formed.

In this example, the image forming unit 10Y includes a charging device 2Y, line photo diode head (hereinafter referred to as "LPH unit 5Y"), development unit 4Y, and image forming member cleaning section 8Y, in addition to the photoreceptor drum 1Y, whereby an yellow (Y) image is formed. The photoreceptor drum 1Y is rotatably mounted close to the upper right of the intermediate transfer belt 6, and forms a yellow (Y) toner image. In this example, the photoreceptor drum 1Y is rotated in the counterclockwise direction by a rotation transfer mechanism (not illustrated). Diagonally down to the right of the photoreceptor drum 1Y, a charging device 2Y is mounted to charge the surface of the photoreceptor drum 1Y to a predetermined voltage level.

Approximately just beside the photoreceptor drum 1Y, a LPH unit 5Y is mounted face to face therewith, and a laser beam having a predetermined intensity in conformity to the Y-color input image data is collectively applied to the previously charged photoreceptor drum 1Y. The LPH unit 5Y to be used has the LED heads (not illustrated) arranged in a line. Instead of the LPH unit, a scanning exposure system by polygon mirror (not illustrated) and others can be used in the image writing system. A Y-color electrostatic latent image is formed on the photoreceptor drum 1Y.

The development unit 4Y is mounted above the LPH unit 5Y, and is used to develop the Y-color electrostatic latent image formed on the photoreceptor drum 1Y. The development unit 4Y has a Y-color development roller (not illustrated). The development unit 4Y also contains Y-color toner agent and a carrier.

The Y-color development roller has a magnet arranged inside. The two-component developer obtained by stirring the carrier and Y-color toner agent in the development unit 4Y is conveyed by rotation to the opposing position of the photoreceptor drum 1Y, and electrostatic latent image is developed by the Y-color toner agent. The Y-color toner image formed by this photoreceptor drum 1Y is transferred onto the intermediate transfer belt 6 by the operation of the primary transfer roller 7Y (primary transfer). A cleaning section 8Y is mounted on the lower left of the photoreceptor drum 1Y to remove the toner agent remaining on the photoreceptor drum 1Y after previous writing operation.

In this example, an image forming unit 10M is arranged below the image forming unit 10Y. The image forming unit 10M is provided with a photoreceptor drum 1M, charging device 2M, LPH unit 5M, development unit 4M, and image forming member cleaning sections 8M, whereby a magenta (M) image is formed. An image forming unit 10C is mounted below the image forming unit 10M. The image forming unit 10C is provided with a photoreceptor drum 1C, charging device 2C, LPH unit 5C, development unit 4C, and image forming member cleaning section 8C, whereby an cyan (C) image is formed.

An image forming unit 10K is arranged below the image forming unit 10C. The image forming unit 10K is provided with the photoreceptor drum 1K, charging device 2K, LPH unit 5K, development unit 4K, and image forming member cleaning section 8K, whereby the black (BK) image is formed. Organic photo conductor (OPC) drums are used as the photoreceptor drums 1Y, 1M, 1C, and 1K.

The description of the functions of the image forming unit 10Y applies to those of the image forming units 10M through 10K when they have the same reference numerals as those of the image forming unit 10Y, wherein Y should be replaced by M, C, or K, and therefore the description thereof will be omitted to avoid duplication. The primary transfer bias voltage (positive in the present embodiment) opposite to that of the toner agent to be used is applied to the primary transfer rollers 7Y, 7M, 7C, and 7K.

The intermediate transfer belt 6 forms a color toner image (color image) by superimposing the toner images transferred by the primary transfer rollers 7Y, 7M, 7C, and 7K. The color image formed on the intermediate transfer belt 6 is fed toward the secondary transfer roller 7A by the rotation of the intermediate transfer belt 6 in the clockwise direction. The secondary transfer roller 7A is located below the intermediate transfer belt 6, and the color toner image formed on the intermediate transfer belt 6 is collectively transferred onto paper P (secondary transfer). The secondary transfer roller 7A is provided with a cleaning section 7B to remove the toner agent remaining on the secondary transfer roller 7A in the previous transfer operation.

A registration sensor 26 serving as an example of the mark detecting section is mounted at the upstream side of the secondary transfer roller 7A. This registration sensor 26 detects the registration mark 41*a* formed on the intermediate transfer belt 6 during the operation in the color misregistration correction mode. The control section 50 (FIG. 8) provides control in such a way as to correct the color misregistration of an image formed on paper in conformity to the registration mark 41*a* detected by the registration sensor 26. The sensor incorporating the LED light sources of R, G, and B colors, for example, is used as this registration sensor 26.

A cleaning section 8A is mounted on the top left side of the intermediate transfer belt 6 to remove the toner remaining on the intermediate transfer belt 6 after transfer operation. The cleaning section 8A is provided with a discharging section (not illustrated) for removing electric charge from the intermediate transfer belt 6, and a pad for removing the remaining toner from the intermediate transfer belt 6. The belt surface is cleaned by this cleaning section 8A and the intermediate transfer belt 6 having been discharged by the discharging section enters the next image formation cycle. This arrangement allows a color image to be formed on paper P.

The color photocopier 100 contains a sheet feed section 20 and fixing apparatus 17 in addition to the image forming section 80. The sheet feed section 20 is arranged below the image forming unit 10K, and includes a plurality of sheet feed trays (not illustrated). Each sheet feed tray accommodates paper P of a predetermined size.

A paper conveyance section 22 for conveying paper P supplied from the sheet feed section 20 is located below the color photocopier 100. The paper conveyance section 22 serving as an example of the conveyance device includes a conveyance rollers 22A through 22C, registration roller 23, sheet ejection roller 22D and others.

The conveyance rollers 22A through 22C are arranged in the vicinity of the sheet feed section 20. It conveys the paper P supplied from this sheet feed section 20 and feeds it out to the registration roller 23. The paper P fed out of the conveyance roller 22C is held just before the secondary transfer roller 7A a by the registration roller 23 and is fed to the secondary transfer roller 7A in conformity to image timing. The color image carried by the intermediate transfer belt 6 is transferred by the secondary transfer roller 7A onto a predetermined paper P whose conveyance is controlled by the registration roller 23.

A fixing apparatus 17 is installed at the downstream side of the secondary transfer roller 7A, and the paper with color image transferred thereon is fixed. The fixing apparatus 17 includes a fixing roller 17A, pressure roller 17B, fixing cleaning section 17C and heater IH (not illustrated). After fixing, the paper is passed between the fixing roller 17A heated by the heater and the pressure roller 17B, whereby the paper is heated and pressed. Thus, the toner transferred to paper is fixed on this paper. The fixing cleaning section 17C removes the remaining toner from the fixing roller 17A.

A sheet ejection roller 22D is arranged at the downstream side of the fixing apparatus 17. Paper P conveyed by the paper conveyance section 22 is sandwiched by the sheet ejection roller 22D, and the paper is ejected onto the ejection tray (not illustrated) outside the apparatus. The color photocopier 100 has the structure as described above.

Figure 2:
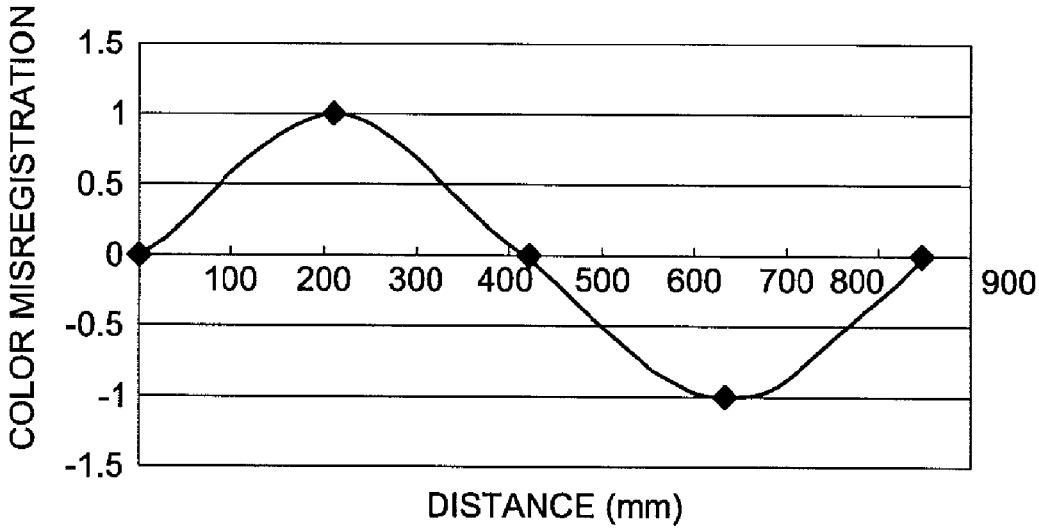
FIGS. 2 (A) and 2(B) are a chart showing an example of color misregistration resulting from fluctuation.
Figure 2:
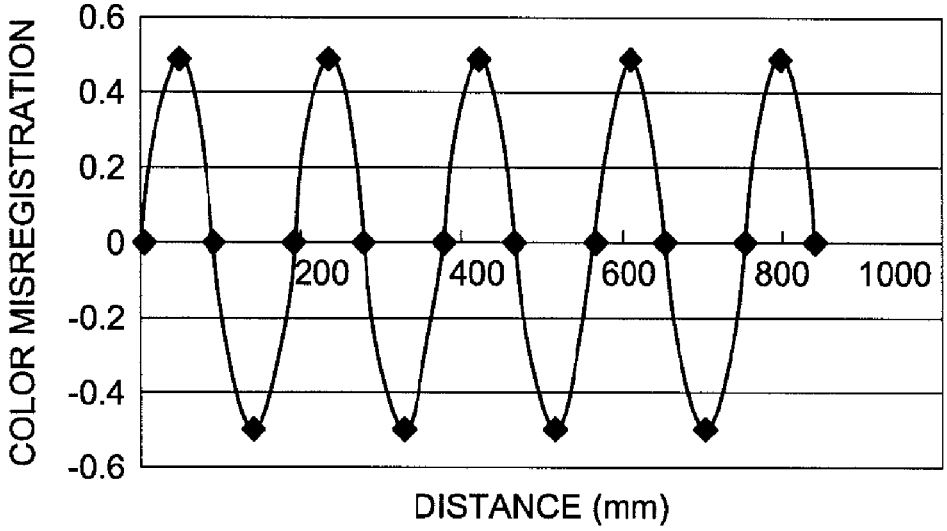

In this example, periodic fluctuation may occur to the intermediate transfer belt 6 and photoreceptor drum 1Y. For example, FIGS. 2 (A) and (B) are the chart showing an example of color misregistration resulting from fluctuation. FIG. 2 (A) is a chart showing the color misregistration caused by the fluctuation of the intermediate transfer belt 6. The pixel is plotted on the vertical axis of this chart, whereas the orbiting distance of the belt is plotted on the horizontal axis.

In this example, one orbiting distance of the intermediate transfer belt 6 corresponds to 862 mm. The chart of FIG. 2 (A) indicates the color misregistration in one orbiting distance of the intermediate transfer belt 6. For example, color misregistration of one pixel occurs at an orbiting distance of 215.5 mm in the positive direction, and the color misregistration is reduced to zero at an orbiting distance of 423 mm. Further, color misregistration of one pixel occurs at an orbiting distance of 634.5 mm in the negative direction, and the color misregistration is reduced to zero at an orbiting distance of 846 mm. As described above, in response to the orbiting distance of the intermediate transfer belt 6, color misregistration occurs in the range from one pixel in the positive direction to one pixel in the negative direction. To put it another way, periodic color misregistration occurs from one pixel in the positive direction to one pixel in the negative direction for each rotation of the intermediate transfer belt 6.

The color misregistration of the intermediate transfer belt 6 is measured before shipment of the color photocopier 100. For example, an image is formed on the intermediate transfer belt 6, and the reference data for forming this image is compared with the detection data obtained by detecting the image formed on the intermediate transfer belt 6, whereby the color misregistration is measured. Further, the value obtained by simulation can also be used as it is, without color photocopier 100 being used for direct measurement.

FIG. 2(B) is a chart showing the color misregistration resulting from fluctuation of the photoreceptor drums 1Y, 1M, 1C, and 1K. The pixel is plotted on the vertical axis of this chart, whereas the orbiting distance of the belt is plotted on the horizontal axis. In this example, one orbiting distance of each photoreceptor drum corresponds to 188 mm. The chart of FIG. 2 (B) indicates the color misregistration in one orbiting distance of each photoreceptor drum. For example, color misregistration of 0.5 pixel occurs at an orbiting distance of 47 mm in the positive direction, and the color misregistration is reduced to zero at an orbiting distance of 94 mm. Further, color misregistration of 0.5 pixel occurs at an orbiting distance of 141 mm in the negative direction, and the color misregistration is reduced to zero at an orbiting distance of 188 mm. As described above, in response to the orbiting distance of each photoreceptor drum, color misregistration occurs in the range from 0.5 pixel in the positive direction to 0.5 pixel in the negative direction. To put it another way, periodic color misregistration occurs from 0.5 pixel in the positive direction to 0.5 pixel in the negative direction for each rotation of the photoreceptor drum.

The color misregistration of the photoreceptor drum is measured before shipment of the color photocopier 100. For example, an image developed on the photoreceptor drum is transferred, and the reference data for forming this image is compared with the detection data obtained by detecting the image having been transferred, whereby the color misregistration is measured. Further, the value obtained by simulation can also be used as it is, without color photocopier 100 being used for direct measurement.

Figure 3:
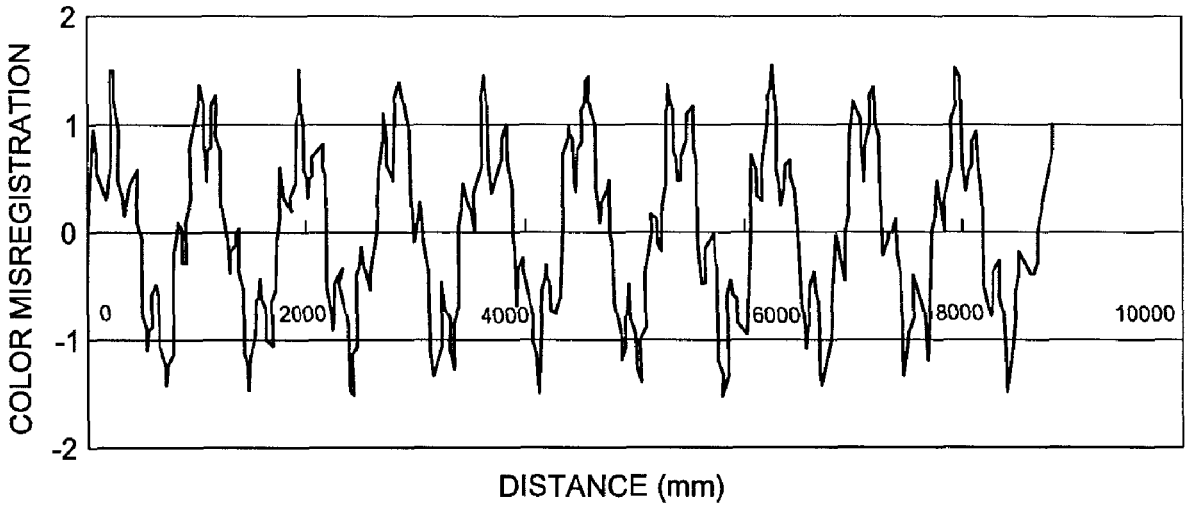
FIG. 3 is a chart showing an example of color misregistration resulting from the fluctuation of a belt and drum.

FIG. 3 is a chart showing an example of color misregistration resulting from the fluctuation of a belt and drum. The pixel is plotted on the vertical axis of this chart, whereas the orbiting distance of the belt is plotted on the horizontal axis. The chart of FIG. 3 represents the total of the color misregistration of the intermediate transfer belt 6 given in FIG. 2 (A) and the color misregistration each photoreceptor drum shown in FIG. 2(B). For example, color misregistration of about 1.5 pixels occurs at an orbiting distance of about 250 mm in the positive direction, and the color misregistration is reduced to zero at an orbiting distance of about 500 mm. Further, color misregistration of about 1.5 pixels occurs at an orbiting distance of about 750 mm in the negative direction, and the color misregistration is reduced to zero at an orbiting distance of about 1000 mm. As described above, in response to the orbiting distance of the intermediate transfer belt 6 and each photoreceptor drum, a period fluctuation of color misregistration occurs in the range from 1.5 pixels in the positive direction to 1.5 pixels in the negative direction.

To circumvent the adverse effect of the periodic fluctuation of the belt and drum obtained in FIG. 3, the optimum registration mark formation period (hereinafter referred to as "optimum mark position") is calculated. In the periodic fluctuation of the color misregistration in the belt and drum, the adverse effect of the belt pitch is large. Accordingly, the optimum mark position is calculated using this belt pitch as a target. It goes without saying that the optimum mark position can be calculated using the drum pitch as a target.

For example, FIGS. 4 (A) and (B) are explanatory diagrams showing an example of calculating the optimum mark position. FIG. 4 (A) shows the values resulting from an odd number of times the half cycle (215.5×2=431 mm) of the belt fluctuating period shown in FIG. 2 (A). In this example, positions are compared between the values corresponding to the odd number of times the half cycle in the belt fluctuating period and the registration marks 41 when the registration marks 41 are formed in respective image areas at predetermined intervals (FIG. 6 (A)). Then out of the values corresponding to the odd number of times the half cycle in the belt fluctuating period, the value closest to the positions of the registration marks 41 at predetermined intervals is set in the optimum mark position, and the registration mark 41*a* is formed in this optimum mark position (FIG. 6(B)).

As described above, with respect to a periodic fluctuation, the optimum mark position is calculated from the odd number of times the half cycle in the fluctuating period and the registration marks 41*a* are formed at intervals corresponding to these optimum mark positions. Then an even number of registration marks 41*a* is averaged. This procedure provides a value close to the average color misregistration of the total.

Incidentally, the registration mark 41*a* is formed between the images formed on the intermediate transfer belt 6 (in the space between sheets of paper). When a registration mark has been formed in the space between sheets of paper at predetermined intervals, it is important to select the position wherein the amount of adjustment of the space between sheets of paper is minimized, because of the registration mark position in the case of normal formation (hereinafter referred to as "normal mark position"). To put it another way, the position closest to the normal mark position should be selected as the optimum mark position. For example, FIG. 4(B) shows the value for the normal mark position. In this example, the fluctuating period (2155 mm) of FIG. 4 (A) is the closest to the eighth normal mark position (2148.3 mm) having been formed. Thus, the registration mark 41*a* is formed at the optimum mark position of 2155 mm reached by retracting normal mark position (2148.3 mm) by about 6.7 mm. This procedure produces a registration mark 41*a* immune to the periodic fluctuation of the intermediate transfer belt 6. Thus, high-precision color misregistration correction is ensured by detecting this registration mark 41*a*.

In the above description, the position for forming a registration mark 41*a* is selected in such a way that the amount of adjustment of the space between sheets of paper is minimized. Namely, the value for the fluctuating period is the closet to the normal mark position is selected as the value for the optimum mark position. However, when the optimum mark position is the closest to the 20th or 30th normal mark position, and this is selected as the position for forming the registration mark 41*a*. Then color misregistration is corrected only when images are formed on a great number of sheets of paper in one operation. This reduces the frequency of correcting the color misregistration. To solve this problem, the closest one of the 10th and lower normal mark positions is preferably selected as the optimum mark position.

Figure 5:
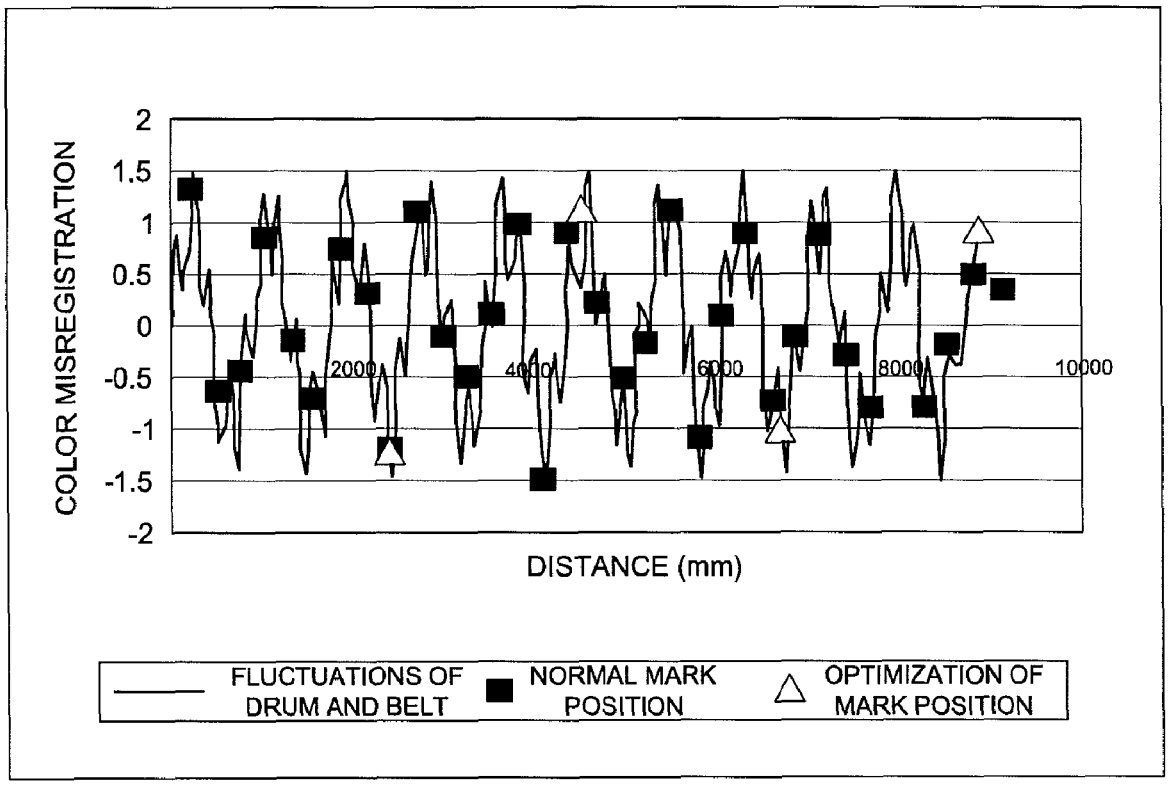
FIG. 5 is a chart showing an example of the optimum mark position.

FIG. 5 is a chart showing an example of the optimum mark position. FIG. 5 is obtained by plotting the normal mark position and optimum mark position against a chart showing an example of the color misregistration caused by the belt drum fluctuation in FIG. 3. The normal mark position (■ in the chart) is plotted according to the value for the mark position in FIG. 4(B). The optimum mark position (Δ in the chart) is plotted according to the value for the mark period in FIG. 4 (A).

When a registration mark 41*a* has been formed at this plotted optimum mark position, namely, when a registration mark 41*a* has been formed by changing the space between sheets of paper in conformity to the optimum detection period (every 8th sheets), the periodic fluctuation is offset if an even number of registration marks 41*a* is averaged. This will give the average color misregistration without including the periodic fluctuation.

For example, if comparison is made between the registration marks 41*a* formed in the optimum mark position P1 (2155 mm) of FIG. 5 and optimum mark position P2 (4310 mm) shown in FIG. 5, the periodic fluctuation (one pixel color misregistration in the positive direction and one pixel color misregistration in the negative direction) will be offset. The result is closer to the average color misregistration without including the periodic fluctuation. Further, the registration mark 41*a* is formed at intervals of eight sheets. This will increase the amount of toner to be consumed.

By contrast, if the registration mark 41 (FIG. 6 (A)) has been formed at the normal mark position (marked by ■ in the chart), namely, if the registration mark 41 has been formed in the space between sheets of paper wherein the space between sheets is kept unchanged, then periodic fluctuation will be given on a random basis, and registration marks 41 are formed in the space between all sheets of paper. This will increase the amount of toner to be consumed.

The following describes an example of forming a registration mark 41 at the normal mark position and an example of forming a registration mark 41*a* at the optimum mark position.

Figure 6:
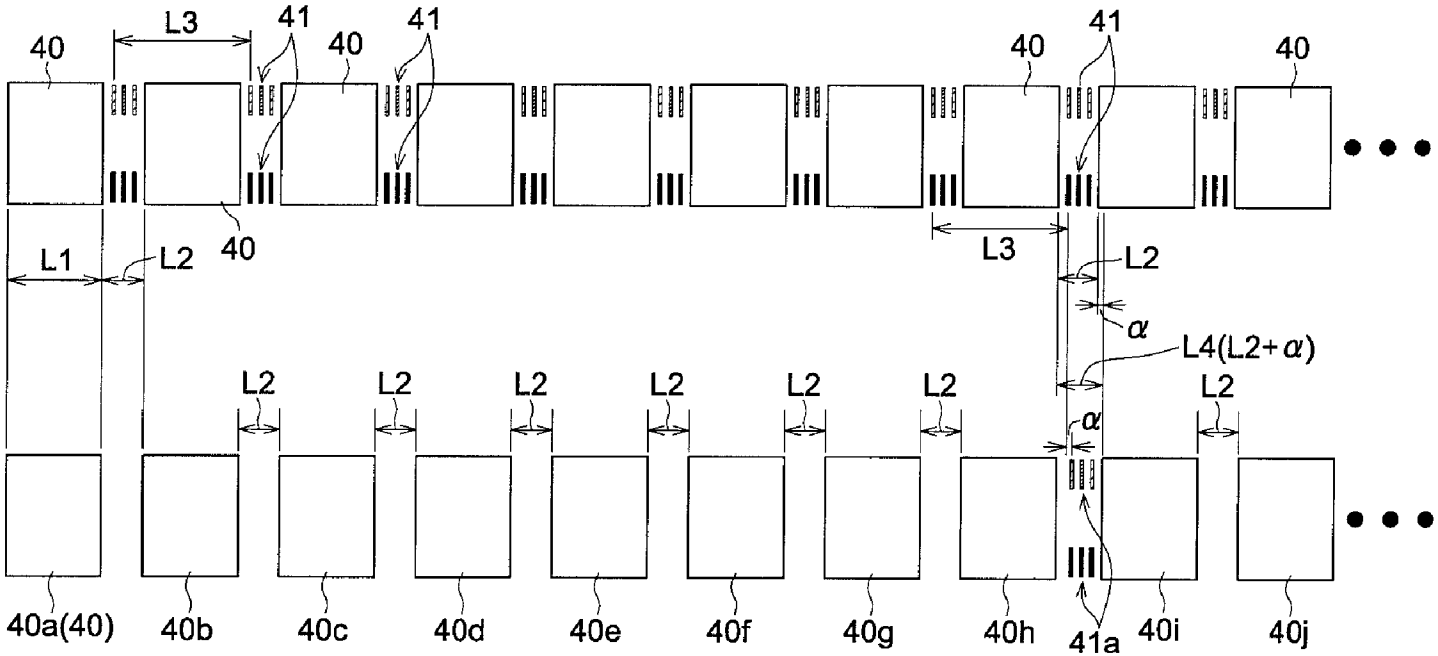
FIGS. 6 (A) and 6(B) are schematic diagram representing an example (No. 1) of forming a registration mark 41 (41*a*)

FIGS. 6 (A) and (B) are schematic diagram representing an example (No. 1) of forming a registration mark 41 (41*a*). FIG. 6 (A) shows the registration mark 41 formed in the normal mark position. For example, when the paper size is A4 (210× 297 mm), the width L1 of the transfer paper area 40 on the intermediate transfer belt 6 is set at 210 mm. Further, the space L2 from this transfer paper area 40 to the next transfer paper area 40 (space between sheets of paper) is set at 66.9 mm. The registration mark 41 is formed in the area of this space L2 between sheets (image area). In this example, the registration mark 41 is made up of the rod-like marks of yellow, magenta, and cyan each formed on the upper portion of the area of the space between sheets L2, and the rod-like marks of black formed on the lower portion of the area along the space between sheets L2 in a manner each corresponding to the rod-like marks of yellow, magenta, and cyan (a total of three). This registration mark 41 is formed in the area of the space L2 between sheets at an interval of distance L3. This distance L3 represents the value obtained by adding the width L1 of the transfer paper area 40 and the space L2 between sheets.

By contrast, in the intermediate transfer belt 6 of FIG. 6 (B), a registration mark 41*a* is formed in the optimum mark position. In this example, in the case of A4-sized paper, the width L1 of the transfer paper area 40 of the intermediate transfer belt 6 is set at 210 mm. Further, the space L2 between this transfer paper area 40*a* and the next transfer paper area 40*b* (space between sheets) is set at 66.9 mm. In this case, the registration mark 41*a* is formed in the optimum mark position alone. For example, as described with reference to FIG. (4), the first registration mark 41*a* is formed in the optimum mark position of 2155 mm reached by retracting the normal mark position (2148.3 mm) by about the fluctuation distance α (=6.7 mm). At the same time, it is moved to the position which is reached by retracting the transfer paper area 40*i* by about the fluctuation distance α. In this case, the space L4 between sheets between the transfer paper area 40*h* and 40*i* corresponds to the value obtained by adding the fluctuation distance α to the space L2 between sheets. The space between sheets from the next transfer paper area 40*j* is put back to the normal distance L2 between sheets. Then a second registration mark 41*a* is formed in the optimum mark position of 4310 mm reached by retracting the next 8th normal mark position (4296.6 mm) by about the fluctuation distance α (=6.7 mm). At the same time, it is moved to the position reached by retracting the transfer paper area 40 by about the fluctuation distance α.

For example, these first and the second registration marks 41*a* are detected, and color misregistration is corrected according to these registration marks 41*a*, whereby the fluctuation is offset. This arrangement circumvents the adverse effect of the periodic fluctuation of the intermediate transfer belt 6 upon the operation of correcting the image color misregistration. Further, registration marks 41*a* are formed at intervals of eight sheets, and this procedure reduces the amount of toner to be consumed.

Figure 7:
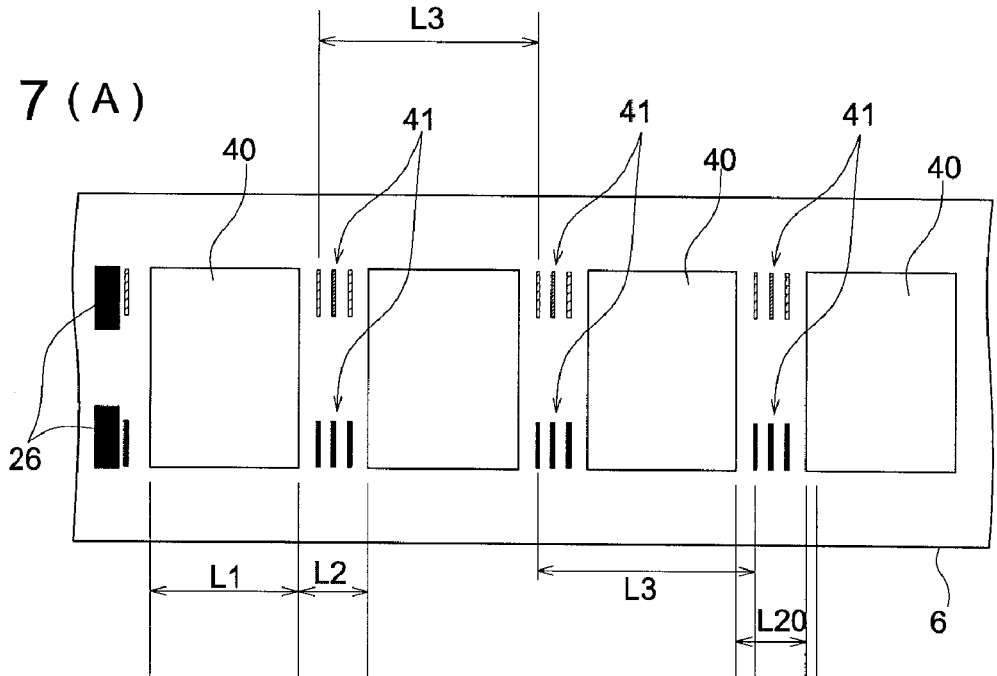
FIGS. 7 (A) and 7(B) are top views representing an example (No. 2) of forming a registration mark 41 (41*a*)
Figure 7:
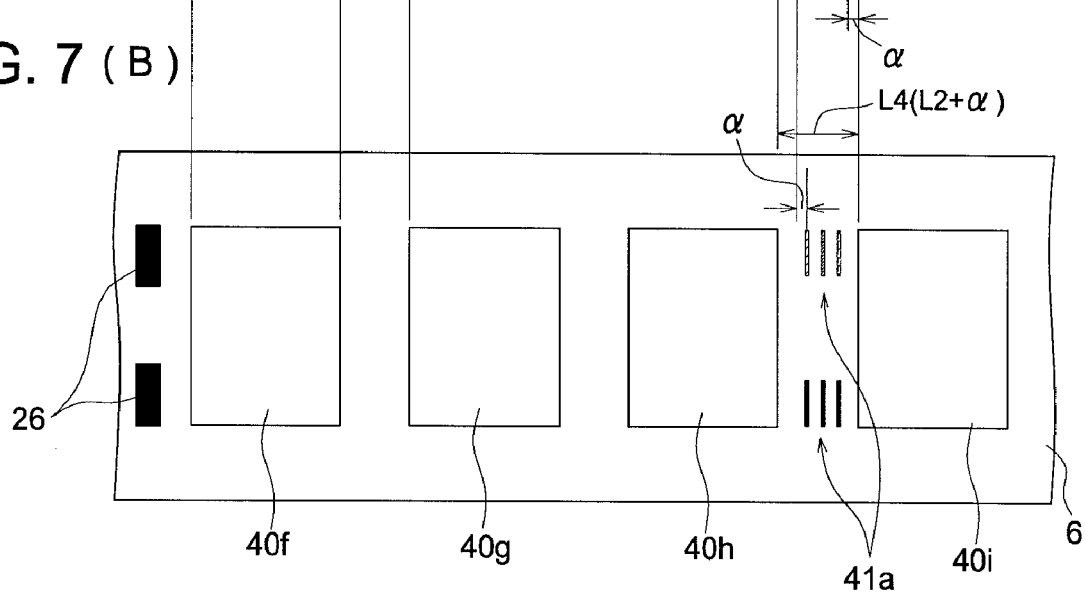

FIGS. 7 (A) and (B) are top views representing an example (No. 2) of forming a registration mark 41 (41*a*). On the intermediate transfer belt 6 of FIG. 7 (A), a registration mark 41 is formed in the normal mark position, as shown in FIG. 6 (A). This registration mark 41 is made up of the rod-like marks of yellow, magenta, and cyan each formed on the upper portion of the area of the space L2 between sheets, and the rod-like marks of black formed on the lower portion of the area of the space L2 between sheets. Two registration sensors 26 for reaching the registration marks 41 formed on the upper and lower portions of the space L2 between sheets are arranged above the intermediate transfer belt 6.

On the intermediate transfer belt 6 of FIG. 7(B), a registration mark 41*a* is formed in the optimum mark position, as shown in FIG. 6(B). Two registration sensors 26 located above the intermediate transfer belt 6 detect the first registration mark 41*a* formed in the optimum mark position which can be reached by retracting from the normal mark position by about the fluctuation distance $\alpha$. They also detect the second registration mark 41*a* formed in the optimum mark position which can be reached by retracting from the next 8th normal mark position by about fluctuation distance $\alpha$.

FIG. 8 is a block diagram showing an example of the structure of the control system of a color photocopier 100. The control system of the color photocopier 100 of FIG. 8 is provided with a control section 50 and image memory 31. The control section 50 serves an example of the control device, and is equipped with a system bus 55. This system bus 55 is connected with an I/O port 54, EEPROM (Electrically Erasable and Programmable Read Only Memory) 53, RAM (Random Access Memory) 52, and CPU (Central Processing Unit) 51.

The EEPROM 53 constitutes an example of the storage section. This EEPROM 53 stores a color misregistration correction control program which controls the operation of forming a registration mark 41*a* on the intermediate transfer belt 6 and correcting the color misregistration in conformity to this registration mark 41*a*. In this example, the fluctuating period of the color misregistration conforming to the orbiting distance of the intermediate transfer belt 6 is calculated just before the shipment of the color photocopier 100, as shown in FIG. 2(A), and the optimum mark position (2155 mm in this example) closest to this normal mark position is calculated from the fluctuating period of the color misregistration and the normal mark position shown in FIG. 4 (B). The result is stored in the EEPROM 53. The CPU 51 reads the color misregistration correction control program from the EEPROM 53, and displays it on the RAM 52. The RAM 52 displays the relevant program and is used as a work memory.

The CPU 51 is connected with the operation panel 30. In this example, this operation panel 30 is operated by the user, and the printing operation starts. When the printing of paper has been started, the image information is read from the document by the document image scanning exposure apparatus of the document reading section 102, whereby a image signal subjected to photoelectric conversion is obtained. This image signal is subjected to A/D conversion, shading correction and other processing in an image processing device (not illustrated), and is converted into the digital image input data R, G, and B. After that, this image input data R, G, and B is subjected to predetermined image processing. The image forming data Y, M, C, and BK for Y-, M-, C-, and BK-color after image processing is outputted to the image memory 31.

The CPU 51 provides control in such a way that the Y-color image forming data Y of the image memory 31 is outputted to the LPH unit 5Y of the image forming section 80. The LPH unit 5Y is controlled by the CPU 51 so that the laser beam having a predetermined intensity based on the Y-color image forming data Y is collectively applied to the previously charged photoreceptor drum 1Y. After that, the Y-color electrostatic latent image formed by the photoreceptor drum 1Y is developed by the Y-color toner agent. Then the primary transfer is conducted.

The CPU 51 controls the drive of the registration roller 23 of the sheet feed section 20. The paper supplied from the sheet feed section 20 is once held just before the secondary transfer roller 7A. Then the paper is fed out toward the secondary transfer roller 7A in perfect synchronization with the image. After that, the processing of secondary transfer and fixing is performed.

The CPU 51 allows the prints to be counted by a counter (not illustrated). For example, when the count value has exceeded 500, the CPU 51 enters the color misregistration correction mode and starts to correct image color misregistration. It goes without saying that the count value for starting this color misregistration correction is not restricted to 500—it can be 300, 700, and so forth.

The CPU 51 controls the paper conveyance section 22 in such a way as to read the optimum mark position stored in the EEPROM 53 and to change the interval of feeding paper in conformity to this optimum mark position. For example, the CPU 51 provides control that allows the registration roller 23 of the paper conveyance section 22 to start the rotation later than normal timing, based on the optimum mark position. Thus, the paper held just before the secondary transfer roller 7A is fed out to the secondary transfer roller 7A with a slight delay.

The CPU 51 controls the image forming section 80 to ensure that the position of the registration mark 41 is changed to the space L4 between sheets (FIG. 7(B)) obtained by expanding the space L2 between sheets of the intermediate transfer belt 6, based on the optimum mark position, so that forming operation is performed. For example, the CPU 51 ensures the Y-color image forming data Y of the image memory 31 to be outputted to the LPH unit 5Y of the image forming section 80 at delayed time intervals in conformity to the optimum mark position. The LPH unit 5Y collectively applies a laser beam conforming to the Y-color image forming data Y to the previously charged photoreceptor drum 1Y. Further, the CPU 51 controls the LPH units 5M, 5C, and 5K in the similar manner.

Thus, the space L4 between sheets with the distance increased by the fluctuation distance $\alpha$ can be set between the transfer paper areas 40*h* and 40*i* of the intermediate transfer belt 6, as shown in FIG. 6(B) and FIG. 7(B). At the same time, the registration mark 41*a* can be formed on this space L4 between sheets. This arrangement makes it possible to detect high-precision color misregistration without being adversely affected by the periodic fluctuation of the intermediate transfer belt 6.

The registration mark 41*a* formed on the intermediate transfer belt 6 is detected by the registration sensor 26. For example, the registration sensor 26 emits the LED light of R, G, and B colors to the registration mark 41*a* and receives the light reflected from the registration mark 41*a*, whereby the mark position is detected. The registration sensor 26 is connected to the CPU 51 via the I/O port 54, and outputs the detected mark position information DD to the CPU 51.

The CPU 51 corrects image color misregistration in conformity to this mark position information DD. For example, the CPU 51 calculates the space between sheets from the mark position information DD, and compares between the space between sheets on the reference data used to form the registration mark 41*a*, and the space between sheets calculated from the mark position information DD. After comparison, if there is a difference between the space between sheets calculated from the mark position information DD and the space between sheets of the reference data, the CPU 51 controls the image writing timing of each LPH unit of the image forming section 80 for the purpose of correcting the space between sheets obtained from the mark position information DD into that of the reference data.

Figure 9:
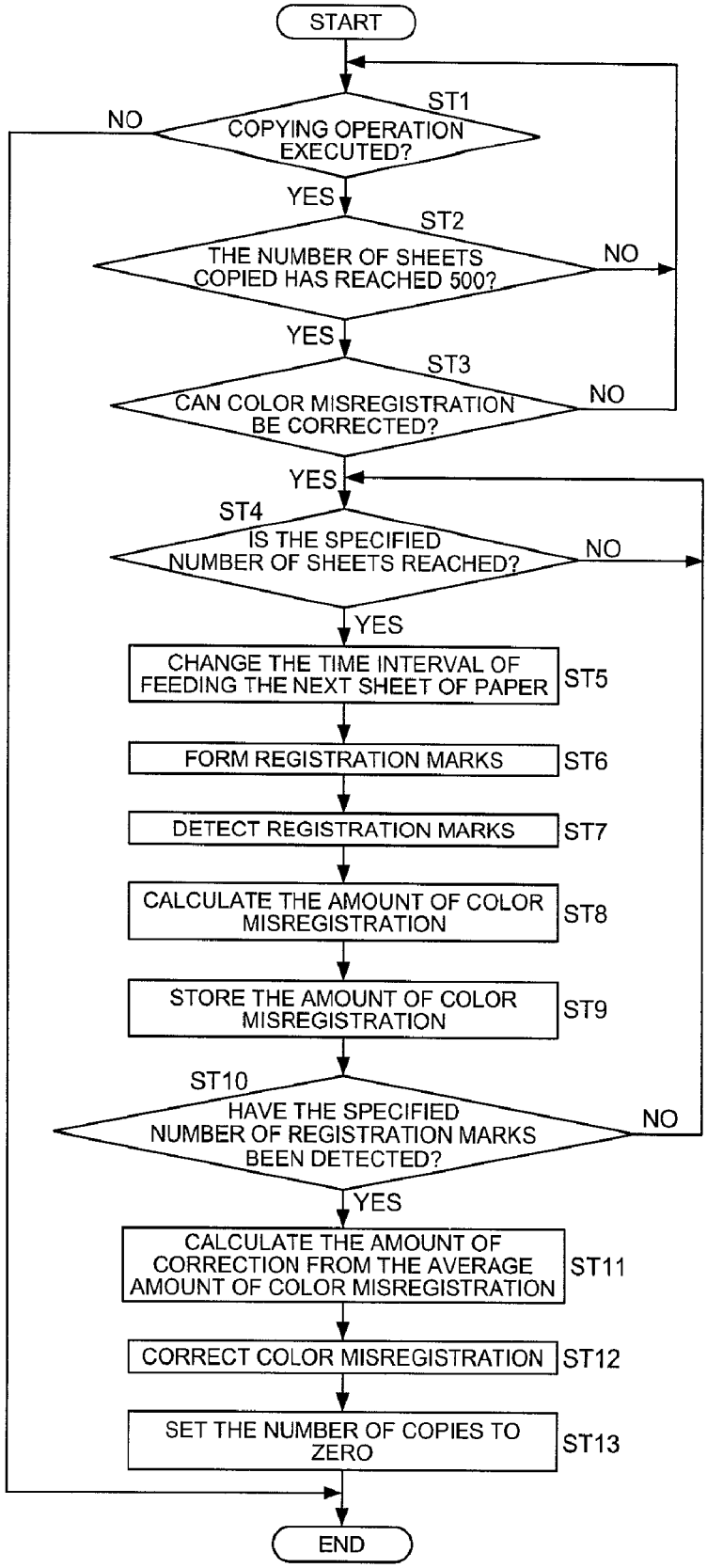
FIG. 9 is a flow chart showing an example of the operation of the CPU 51 for controlling a color photocopier 100.

FIG. 9 is a flow chart showing an example of the operation of the CPU 51 for controlling a color photocopier 100. This color photocopier 100 is set in such a way that when the number of copies has exceeded a target of 500 sheets, the current mode is changed to the color misregistration correction mode, and the processing of correcting the image color misregistration is initiated. It is so programmed that the registration mark 41*a* is formed twice and the two registration marks 41*a* having been formed are detected to correct the color misregistration correction. Further, the EEPROM 53 of the color photocopier 100 stores the optimum mark position (2155 mm) calculated in FIGS. 4 (A) and (B). Based on the conditions for processing the color misregistration correction, the following describes the details of the flow for each Step:

When the power source (not illustrated) has been turned on and the color misregistration correction control program stored in the EEPROM 53 has been displayed on the RAM 52, the CPU 51 determines in Step ST1 of FIG. 9 if the process of copying should be executed or not. For example, a new job has been inputted to specify the process of copying or the copy job currently in progress is to be executed, the system proceeds to Step ST2. If copying is not performed, the system goes to END.

In Step ST2, the CPU 51 determines whether or not the number of copies has reached the target level (500 sheets) for entering to the color misregistration correction mode. For example, the CPU 51 allows the counter (not illustrated) to count the copies and compares the count value with the target value. If the target value of the count value has not yet been reached, the system goes back to Step ST1 wherein copying operation is performed. If the target value of the count value has been reached, the system enters the color misregistration correction mode and proceeds to Step ST3.

In Step ST3, the CPU 51 determines if the requirements for executing the color misregistration correction have been met or not. Here the CPU 51 reads the optimum mark position (2155 mm) stored in the EEPROM 53 and compares among the number of remaining sheets to be copied in one job, the optimum mark position (2155 mm), and the number of registration marks 41*a* having been formed (two marks). It then determines if the two registration marks 41*a* can be formed in the remaining copies or not. To put it another way, in the present flow, if the number of sheets to be copied is 16 or more, it is determined that the process of color misregistration correction can be executed, and the system goes to ST4. If the number does not exceed 15, it is determined that the process of color misregistration correction cannot be executed, and the system goes back to ST1. In this case, a step is taken to determine whether or not color misregistration correction can be executed in one job. It is also possible to make such arrangements that a decision is made to see whether or not color misregistration correction is to be performed over a plurality of jobs.

In Step ST4, the CPU 51 determines whether or not the number of sheets to be copies has reached a predetermined level (8 sheets). For example, the CPU 51 allows the counter (not illustrated) to count the copies and compares the count value with the reference value. If the count value has not reached the reference value, the copying operation is continued until the reference level is reached. If the count value has reached the reference value, the system proceeds to Step ST5.

In Step ST5, the CPU 51 controls the paper conveyance section 22 to change the time interval of feeding the next sheet. For example, the CPU 51 reads the optimum mark position (2155 mm) stored in the EEPROM 53, and ensures the ninth sheet to be fed out the transfer paper area 40*i* (FIG. 7(B)) related to the optimum mark position (2155 mm) reached by retracting from the normal mark position (2148.3 mm) by about 6.7 mm. The rotation of the registration roller 23 of the paper conveyance section 22 is performed later than the normal rotation. This procedure ensures that the paper held just before the secondary transfer roller 7A is fed out to the secondary transfer roller 7A with a slight delay by the registration roller 23, with the result that agreement between the paper and transfer paper area 40*i* is achieved. The system them goes to Step ST6.

In Step ST6, the CPU 51 allows the registration mark 41*a* to be formed. For example, the CPU 51 forms the registration mark 41*a* in the image area of the intermediate transfer belt 6, based on the optimum mark position (2155 mm) having been read. In this example, the first registration mark 41*a* is formed in the optimum mark position reached by retracting the normal mark position (2148.3 mm) by about the fluctuation distance $\alpha$, as shown in FIG. 6(B). At the same time, an image is formed in the transfer paper area 40*i* reached by retracting by about the fluctuation distance $\alpha$. Then the system goes to Step ST7.

In Step ST7, the CPU 51 receives the mark position information DD from the registration sensor 26 having detected the first registration mark 41*a* formed on the intermediate transfer belt 6. Then the system goes to Step ST8.

In Step ST8, the CPU 51 calculates the amount of color misregistration in conformity to the mark position information DD having been inputted. For example, the CPU 51 gets the position of the first registration mark 41*a* from the mark position information DD. Then the CPU 51 compares between the position of the reference data used to form this registration mark 41*a* and the position of the registration mark 41*a* obtained from this mark position information DD, thereby calculating the amount of color misregistration. Then the system goes to Step ST9, and the CPU 51 stores the calculated color misregistration in the EEPROM 53. After that, the system goes to Step ST10.

In Step ST10, the CPU 51 determines if a specified number of registration marks 41*a* has been detected or not. In this example, when the first and the second registration marks 41*a* have been detected, the CPU 51 is programmed to determine that the number of the detected registration marks 41*a* has reached the specified number. Thus, if only the first registration mark 41*a* has been detected, the CPU 51 determines that the number of detected registration marks 41*a* has not yet reached the specified level, and the system goes back to Step ST4. When the number of copies has reached the specified level (8 sheets) subsequent to the return of the specified number to 0, the procedures in Step ST5 through Step ST9 are repeated. To put it more specifically, procedures to be implemented include change of the time interval of next feed, formation of the second registration mark, detection of the second registration mark, calculation of the color misregistration of the second registration mark, storage of the amount of color misregistration. Then the system goes to Step ST11.

In Step ST11, the CPU 51 calculates the amount of correction from the average amount of color misregistration. For example, the CPU 51 finds the average of the amount of color misregistration calculated from the first registration mark 41*a* and the amount of color misregistration calculated from the second registration mark 41*a*, and calculates the amount of correction.

As described with reference to FIG. 5, when the average has been found regarding the registration marks 41*a* formed at the optimum mark position P1 (2155 mm) and optimum mark position P2 (4310 mm), the periodic fluctuation (one pixel color misregistration in the positive direction and one pixel color misregistration in the negative direction) is offset, and the result comes closer to the average amount of color misregistration without including periodic fluctuation. Further, a registration mark 41*a* is formed for every eight sheets, and this arrangement reduces the amount of toner to be consumed. The system goes to Step ST10.

In Step ST12, the CPU 51 corrects the color misregistration. For example, the CPU 51 controls the image writing time intervals of the LPH unit of the image forming section 80 so that the color misregistration is corrected. Then the system goes to Step ST13.

In Step ST13, the CPU 51 sets the count value (500) to zero in order to enter the color misregistration correction mode.

As described above, in the color photocopier 100 and correction method of color misregistration in an image as a first embodiment of the present invention, in the color misregistration correction mode, the paper conveying interval is changed based on the fluctuating period of color misregistration calculated in conformity to the orbiting distance of each of the intermediate transfer belt 6 and photoreceptor drums. At the same time, the position of forming the color misregistration correction registration mark 41*a* is also changed.

The intermediate transfer belt 6 and photoreceptor drum are often subjected to periodic fluctuation because the drive roller is decentered or the film thickness is not uniform. In this case, if registration marks are formed between sheets at predetermined intervals as in the conventional art, an error is produced at each mark formed position by the periodic fluctuation. Even if the registration mark is detected and color misregistration is corrected, high-precision color misregistration correction cannot easily be achieved.

By contrast, in the first embodiment of the present invention, as described above, the fluctuation period of the color misregistration is calculated based on the orbiting distance of the intermediate transfer belt 6 and photoreceptor drum. The position of forming the color misregistration correction registration mark 41*a* is changed in conformity to this fluctuating period.

Thus, the first embodiment of the present invention produces the color misregistration correction registration mark 41*a* immune to the periodic fluctuation of the intermediate transfer belt 6 or photoreceptor drum in the color misregistration correction mode during the paper feed. Accordingly, high-precision color misregistration can be corrected by detecting this registration mark 41*a*.

In the above description, the first registration mark is formed in the space between the 8th and 9th sheets, and the second registration mark is formed in the space between the 16th and 17th sheets. It is also possible to make such arrangements, for example, that the first registration mark is formed in the space between the first and second sheets. In this case, the second registration mark should be formed in the space between the 9th and 10th sheets.

The following describes the color photocopier 200 and correction method of color misregistration in an image as a second embodiment: In the example shown with reference to first embodiment, the optimum mark position (2155 mm) obtained in FIGS. 4 (A) and (B) is calculated before shipment, and is stored in the EEPROM 53. In the example of the second embodiment, the optimum mark position is automatically calculated during the copying operation.

Second Embodiment

Figure 10:
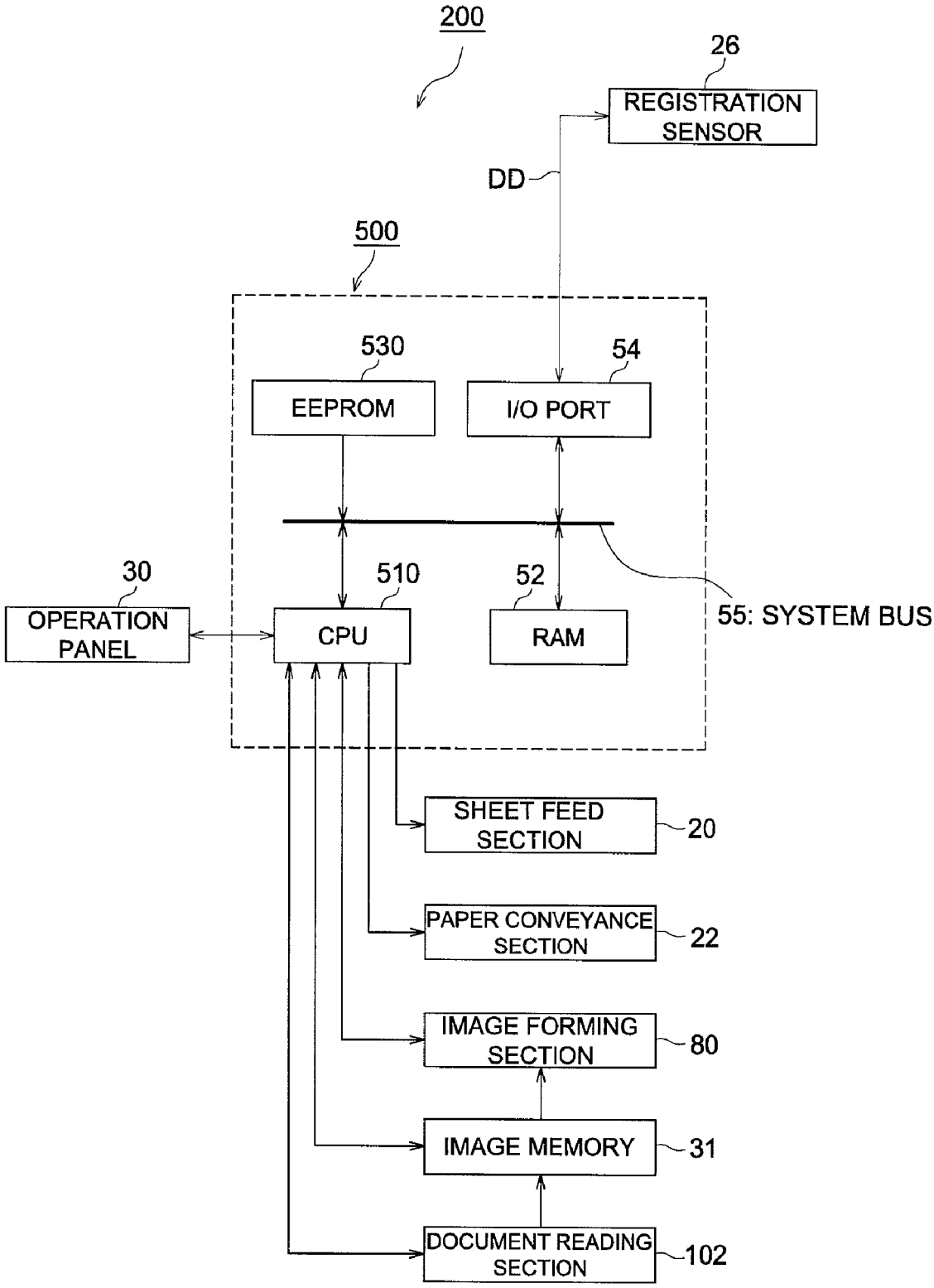
FIG. 10 is a block diagram showing an example of the structure of the control system of the color photocopier 200.

FIG. 10 is a block diagram showing an example of the structure of the control system of the color photocopier 200. The components of the control system of the color photocopier 200 of FIG. 10 are assigned with the same reference numerals as those of the color photocopier 100 of FIG. 8 if they are the same, and the details thereof will not be described to avoid duplication of explanation. In this example, the components of the control system different from those of the color photocopier 100 of FIG. 8 are restricted to the EEPROM 530 and CPU 510 of the control section 500.

The EEPROM 530 does not incorporate the optimum mark position (2155 mm) obtained in FIGS. 4 (A) and (B). The CPU 510 automatically calculates the optimum mark position during the copying operation.

Figure 11:
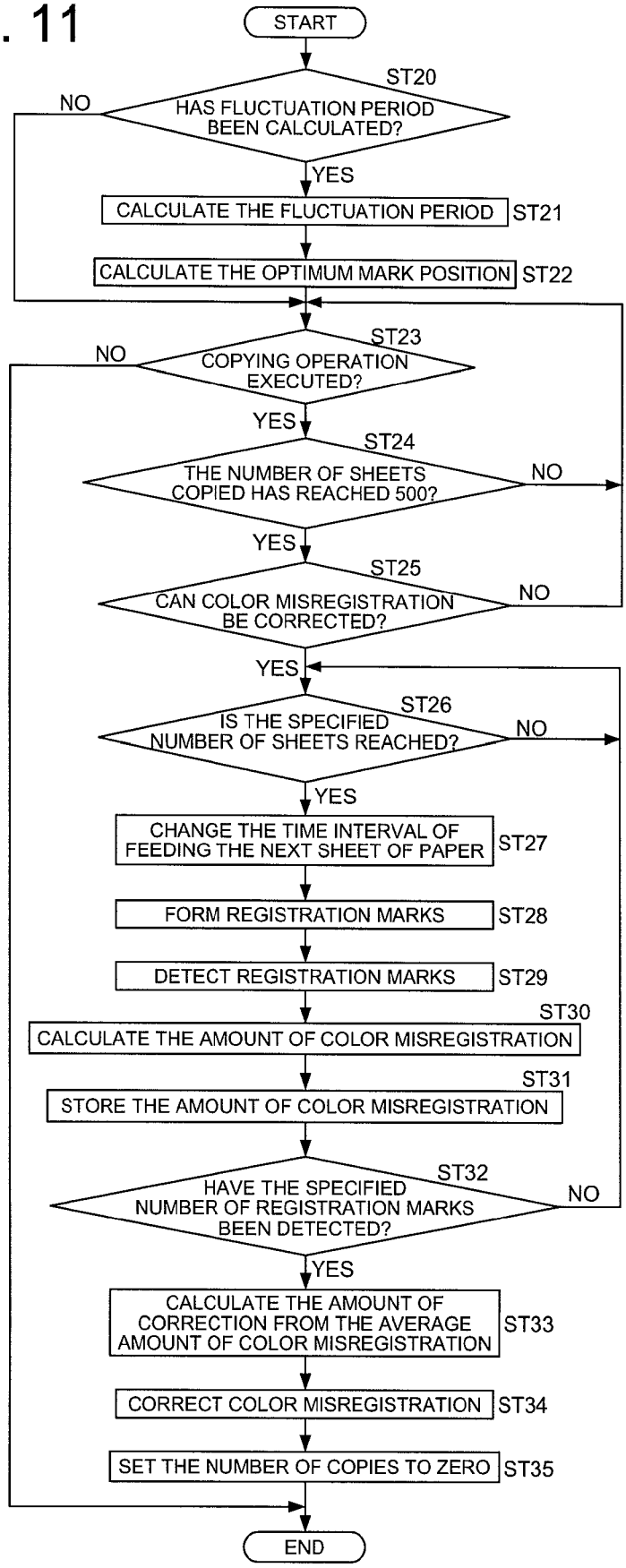
FIG. 11 is a flow chart showing an example of the operation of the CPU 510 for controlling a color photocopier 200.

FIG. 11 is a flow chart showing an example of the operation of the CPU 510 for controlling a color photocopier 200 of the second embodiment. This color photocopier 200 is so programmed that when the number of sheets copied has exceeded 500, the system enters the color misregistration correction mode to initiate the processing of image color misregistration correction. Further, it is also programmed in such a way as to form a registration mark 41*a* twice and to detect these two registration marks 41*a*, thereby starting color misregistration correction. These procedures are assumed as the conditions for the processing of color misregistration correction and the flow thereof will be described for each step. When the power source (not illustrated) has been turned on, the color misregistration correction control program stored in the EEPROM 530 is implemented on the RAM 52. In the following description, the same steps as those in the example of the operation of the CPU 51 of the color photocopier 100 in FIG. 9 will be omitted.

In Step ST20 of FIG. 11, after the power source has been turned on, the CPU 510 accesses the RAM 52 and determines if the fluctuating period and optimum mark position have been calculated or not. If the fluctuating period and optimum mark position have been calculated, the system goes to Step ST23. If the fluctuating period and optimum mark position have not been calculated, to put it another way, if the fluctuating period and optimum mark position are not stored in the RAM 52, the system goes to Step ST21. In the present embodiment, the fluctuating period and optimum mark position are deleted when the power source ha been turned off. Thus, they are calculated whenever the power source is turned on.

In Step ST21, the CPU 510 calculates the fluctuating period. For example, the CPU 510 allows the image forming section 80 to form a registration mark on the intermediate transfer belt 6 at predetermined intervals. After that, the CPU 510 gets the mark position information DD from the registration sensor 26 having detected the registration mark formed on the intermediate transfer belt 6, and calculates the position of the registration mark 41 from this mark position information DD. The CPU 510 calculates the difference between the calculated position of the registration mark and the reference position serving as a reference for the registration mark position to obtain the period of this difference (fluctuating period), and stores it in the RAM 52. Then the system goes to Step ST22.

In Step ST22, from the values obtained from an odd number of times the half cycle of the fluctuating period, the CPU 510 calculates the optimum mark position (2155 mm in this example) which is the closest to the normal mark position, and stores the result in the RAM 52. Then the system goes to Step ST23.

Step ST23 through Step ST35 are the same as Step ST1 through Step ST13 of FIG. 9, and will not be described.

As described above, in the color photocopier 200 and correction method of color misregistration in an image as the second embodiment of the present invention, steps are taken to obtain the position of the registration marks formed on the intermediate transfer belt 6 at predetermined intervals; to calculate the period of the difference between the obtained position of the registration mark and the reference position as a reference of the registration mark position to get the period of this difference; and to change the interval of paper feed and the position for forming the registration mark 41*a*, based on this period.

This arrangement ensures formation of color misregistration correction registration marks 41*a*, based on the period of the difference calculated automatically, without being adversely affected by the periodic fluctuation of the intermediate transfer belt 6 and photoreceptor drum. Thus, high-precision color misregistration correction is provided by detection of this registration mark 41*a*.

INDUSTRIAL APPLICABILITY

The present invention is preferably applied to a color printer, color photocopier and multifunction peripheral wherein color misregistration of the image formed on paper are corrected.

What is claimed is:

1. An image forming apparatus that corrects color misregistration of an image to be formed on a recording medium comprising:

a conveyance device for conveying the recording medium;

an image forming device having an endless image carrier for carrying an image to be formed on the recording medium, wherein the image forming device forms the image in an image area that corresponds to the recording medium on the image carrier and also forms a color misregistration correction mark in an image boundary area that is sandwiched between the image area and the next image area following the image area on the image carrier;

a mark detecting section for detecting the color misregistration correction mark formed on the image boundary area of the image carrier by the image forming device; and a control device for providing control in such a way that the color misregistration of the image formed on the recording medium is controlled based on the color misregistration correction mark detected by the mark detecting section;

wherein, under a color misregistration correction mode in which operations of forming the image in the area based on input image information, forming the color misregistration correction mark on the image boundary area of the image carrier, and correcting the color misregistration based on the color misregistration correction mark are executed, the control device controls the conveyance device in such a way that an interval for feeding the recording medium is changed, based on a fluctuating period of the color misregistration corresponding to an orbiting distance of the image carrier, and controls the image forming device in such a way that the image boundary area of the image carrier is expanded, and the color misregistration correction mark is formed at a position changed.

2. The image forming apparatus of claim 1, further comprising:

a storage section for storing a value as the optimum mark forming position, wherein on the assumption of existence of a plurality of color misregistration correction marks formed at a predetermined interval each other in each image boundary area, among values those are odd number of times the half cycle in the fluctuating period, the value as the optimum mark forming position represents a position that is closest to any one of color misregistration correction marks in each image boundary area;

wherein, in the color misregistration correction mode, the control device reads the value as the optimum mark forming position stored in the storage section and controls the conveyance device and image forming device based on this optimum mark forming position.

3. A color misregistration correction method for correcting color misregistration of an image to be formed on a recording medium, comprising:

under a color misregistration correction mode in which operations of forming the image in an image area that corresponds to the recording medium based on input image information, forming a color misregistration correction mark on an image boundary area that is sandwiched between the image area and the next image area following the image area of the image carrier, and correcting the color misregistration based on the color misregistration correction mark are executed, changing an interval for feeding the recording medium based on a fluctuating period of the color misregistration corresponding to an orbiting distance of the image carrier;

expanding the image boundary area of the image carrier; and forming the color misregistration correction mark at a position in the image boundary area that is changed from a position at which the color misregistration correction mark was previously formed;

detecting the color misregistration correction mark at the changed position; and correcting color misregistration of the image to be formed on the recording medium based on the detected color misregistration correction mark.

4. An image forming apparatus that corrects color misregistration of an image to be formed on a recording medium comprising:

a conveyance device for conveying the recording medium;

an image forming device having an endless image carrier for carrying an image to be formed on the recording medium, wherein the image forming device forms the image in an image area that corresponds to the recording medium on the image carrier and also forms a color misregistration correction mark in an image boundary area that is sandwiched between the image area and the next image area following the image area on the image carrier;

a mark detecting section for detecting the color misregistration correction mark formed on the image boundary area of the image carrier by the image forming device, and the marks formed on the image carrier at predetermined intervals; and a control device for providing control in such a way that the color misregistration of the image formed on the recording medium is controlled based on the color misregistration correction mark detected by the mark detecting section;

wherein, under a color misregistration correction mode in which operations of forming the image in the area based on input image information, forming the color misregistration correction mark on the image boundary area of the image carrier, and correcting the color misregistration based on the color misregistration correction mark are executed, the control device calculates a period of a difference between the each position of the marks formed on the image carrier at predetermined intervals and a reference position providing a basis for the mark based on the difference; and controls the conveyance device in such a way that an interval for feeding the recording medium is changed, based on a fluctuating period of the color misregistration corresponding to an orbiting distance of the image carrier, and controls the image forming device in such a way that the image boundary area of the image carrier is expanded, and the color misregistration correction mark is formed at a position changed.

5. A color misregistration correction method for correcting color misregistration of an image to be formed on a recording medium, comprising:

under a color misregistration correction mode in which operations of forming the image in an image area that corresponds to the recording medium based on input image information, forming a color misregistration correction mark on an image boundary area that is sandwiched between the image area and the next image area following the image area of the image carrier, and correcting the color misregistration based on the color misregistration correction mark are executed, forming marks on the image carrier at predetermined intervals;

detecting the marks formed on the image carrier at predetermined intervals;

calculating the positions of the marks at predetermined intervals;

calculating a period of a difference between the each position of the marks formed on the image carrier at predetermined intervals and a reference position providing a basis for the mark based on the difference;

changing an interval for feeding the recording medium based on the calculated period of the difference;

expanding the image boundary area of the image carrier;

forming the color misregistration correction mark at a position in the image boundary area that is changed from a position at which the color misregistration correction mark was previously formed;

detecting the color misregistration correction mark at the changed position; and correcting color misregistration of the image to be formed on the recording medium based on the detected color misregistration correction mark.

* * * * *